US009330869B2

(12) United States Patent
Harada

(10) Patent No.: US 9,330,869 B2
(45) Date of Patent: May 3, 2016

(54) VACUUM VALVE

(71) Applicant: Mitsubishi Electric Corporation, Chiyoda-ku, Tokyo (JP)

(72) Inventor: Takakazu Harada, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/439,906

(22) PCT Filed: Sep. 12, 2013

(86) PCT No.: PCT/JP2013/074677
§ 371 (c)(1),
(2) Date: Apr. 30, 2015

(87) PCT Pub. No.: WO2014/136297
PCT Pub. Date: Sep. 12, 2014

(65) Prior Publication Data

US 2016/0035519 A1 Feb. 4, 2016

(30) Foreign Application Priority Data

Mar. 5, 2013 (JP) ..... 2013-042559

(51) Int. Cl.
*H01H 33/664* (2006.01)
*H01H 33/18* (2006.01)

(52) U.S. Cl.
CPC ..... *H01H 33/6644* (2013.01); *H01H 33/185* (2013.01)

(58) Field of Classification Search
CPC ... H01H 33/66; H01H 33/664; H01H 33/662; H02M 3/155
USPC ..... 218/42, 118, 120, 123–129, 140
See application file for complete search history.

(56) References Cited

U.S. PATENT DOCUMENTS 3,946,179 A 3/1976 Murano et al.
5,597,993 A * 1/1997 Yorita ..... H01H 33/6644 218/129

(Continued)

FOREIGN PATENT DOCUMENTS

JP 50-148565 U 12/1975
JP 56-011431 U 1/1981

(Continued)

OTHER PUBLICATIONS

International Search Report (PCT/ISA/210) mailed on Oct. 8, 2013, by the Japanese Patent Office as the International Searching Authority for International Application No. PCT/JP2013/074677.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A coil electrode has a ring section provided on a plane perpendicular to the axis line of fixed-side and movable-side electrode rods on which the coil electrodes are mounted and concentrically with the axis line, a plurality of arm sections extended outward from the outer circumference of the ring section, circular-arc-shaped coil sections that are formed in such a way as to be bent in the circumferential direction from the respective front ends of the arm sections, and slits that separate the coil sections; the arm section of the coil electrode and the arm section of the coil electrode are arranged in the same direction so as to be superimposed on each other when viewed along the axis direction of the fixe-side electrode rod and the movable-side electrode rod.

4 Claims, 5 Drawing Sheets

(56) References Cited

U.S. PATENT DOCUMENTS

| | | | | |
|---|---|---|---|---|
| 7,173,208 | B2 * | 2/2007 | Harada | H01H 33/6644 218/127 |
| 2006/0124600 | A1 * | 6/2006 | Harada | H01H 33/6644 218/118 |

FOREIGN PATENT DOCUMENTS

| | | | |
|---|---|---|---|
| JP | 1-315914 | A | 12/1989 |
| JP | 7-249352 | A | 9/1995 |
| JP | 11-317134 | A | 11/1999 |
| JP | 2006-164912 | A | 6/2006 |
| JP | 2012-104369 | A | 5/2012 |

OTHER PUBLICATIONS

Japanese Office Action issued Apr. 1, 2014 in Patent Application No. 2014-500191.

Office Action (Reason for Rejection) dated Oct. 28, 2015, issued by the Korean Patent Office in corresponding Korean Patent Application No. 10-2015-7015529, and an English translation of the Office Action. (7 pages).

* cited by examiner

VACUUM VALVE

TECHNICAL FIELD

The present invention relates to a vacuum valve that disperses an arc by means of a magnetic field produced by an electric current flowing in electrodes.

BACKGROUND ART

For example, as disclosed in each of Japanese Patent Application Laid-Open No. H1-315914 (Patent Document 1) and Japanese Patent Application Laid-Open No. H11-317134 (Patent Document 2), a vacuum valve is formed of an insulating material such as a glass material or a ceramic material and includes a cylindrical, bottomed vacuum container whose inside gas is exhausted so as to be high-vacuum, respective electrode rods provided at both ends of the vacuum container, spiral-ring-shaped coil electrodes provided at the respective electrode-rod tips that face each other, and respective disk-shaped contacts connected with the coil electrodes; one of the electrode rods is moved in the axis direction, so that the both contacts (i.e., the fixed-side contact and the movable-side contact) are made to make contact with or separate from each other and hence energization or cutoff is performed.

The coil electrode is explained in each of Patent Documents 1 and 2; i.e., on the rear side of each of the both contacts, a plurality of circular-arc-shaped coil sections are separately arranged in the circumferential direction along the outer circumferential edge of the contact so that an axis-direction magnetic field is produced in the contact/separation direction of the fixed-side and movable-side contacts as the main electrodes; one end of the coil section has an arm section extending toward the center and the other end thereof has a protruding section to be connected with the contact.

In the foregoing vacuum valve, the coil electrode generates an axis-direction magnetic field at a time of energization, and an inter-contact electric arc inevitably produced at a time of cutoff is confined within the diameter of the contact and is concurrently dispersed on the surface of the contact so that the current density on the contact surface is lowered; thus, the cutoff capability of the contact material becomes superior and hence the current can be cut off.

In order to enlarge the cutoff capacity of the vacuum valve, it is indispensable to develop the coil electrode and the contact material; thus, to date, various studies have been carried out. As a result, it is known that the cutoff performance of a vacuum valve is raised in proportion to the intensity, the uniformity, and the area of the axis-direction magnetic field generated by a coil electrode.

PRIOR ART REFERENCE

Patent Document

[Patent Document 1] Japanese Patent Application Laid-Open No. H1-315914

[Patent Document 2] Japanese Patent Application Laid-Open No. H11-317134

DISCLOSURE OF THE INVENTION

Problems to be Solved by the Invention

As explained in each of Patent Documents 1 and 2, in a vacuum valve utilizing the method of raising the cutoff performance by making a magnetic field disperse an electric arc produced between the contacts, an applied electric current flows in the fixed-side and movable-side coil electrodes so that an axis-direction magnetic field is generated between the coil electrodes.

As disclosed in Patent Document 1, each of FIGS. 6 and 7 is an explanatory view for explaining the positional relationship between the fixed-side coil electrode and the movable-side coil electrode and illustrates the state in which the fixed-side coil electrode and the movable-side coil electrode are superimposed on each other. For example, an electric current flowing from a fixed-side electrode rod 4 to a coil electrode flows in an arm section (i.e., a fixed-side arm section) 18 of a fixed-side coil electrode 9, a fixed-side coil section 19, a fixed-side coil protruding section 21, a fixed-side contact (unillustrated), and a movable-side contact (unillustrated), in that order; then, this electric current flows in a protruding section (i.e., a movable-side coil protruding section) 25 of a movable-side coil electrode 11, a movable-side coil section 23, a movable-side arm section 22, in that order, and then flows to a movable-side electrode rod 7.

In this situation, because flowing in the same direction in the fixed side and the movable side, respective magnetic fields generated by the fixed-side and movable-side coil sections 19 and 23 act on each other in a direction for intensifying each other; however, as indicated by solid lines and broken lines in each of FIGS. 6 and 7, the respective magnetic fields flow in directions reverse to each other in the fixed-side arm section 18 and the movable-side arm section 22; thus, the respective generated magnetic fields are in directions reverse to each other and cancel each other. The magnetic fields formed between the fixed-side and movable-side coil electrodes 9 and 11 conform to a principle of superposition for magnetic fields generated in the all sections where the electric current flows, such as the fixed-side and movable-side coil sections 19 and 23, the fixed-side and movable-side arm sections 18 and 22, and the fixed-side and movable-side coil protruding sections 21 and 25; however, in the fixed-side and movable-side coil protruding sections 21 and 25 and the fixed-side and movable-side arm sections 18 and 22 where no axis-direction magnetic field for dispersing an electric arc is generated, the intensity of the magnetic field is lowered.

In the condition illustrated in FIG. 6, the magnetic field generated by the fixed-side and movable-side coil sections 19 and 23 are cancelled by the magnetic field generated by the fixed-side and movable-side arm sections 18 and 22; in addition to that, in the region surrounded by the fixed-side arm section 18, the movable-side arm section 22, and the fixed-side and movable-side coil protruding sections 21 and 25, there is created a region where a magnetic field having a direction reverse to the direction of the magnetic field generated by the fixed-side and movable-side coil sections 19 and 23; therefore, the magnetic-field distribution becomes non-uniform.

In the condition illustrated in FIG. 7, there exists no region where the reverse-direction magnetic field is generated; however, because the arm section (i.e., the fixed-side arm section) 18 of the fixed-side coil electrode 9 and the arm section (i.e., the movable-side arm section) 22 of the movable-side coil electrode 11 are shifted from each other, the arm-section region where the intensity of the magnetic field is lowered is expanded. As a result, because the axis-direction magnetic field for dispersing an electric arc is nonuniform or the area of the axis-direction magnetic field decreases, it is required to enlarge the diameters of the fixed-side and movable-side coil sections 19 and 23 in order to secure the magnetic-field area necessary to cut off the electric arc. The enlarged area leads to upsizing of a vacuum valve and is a factor of the cost hike.

In order to eliminate the region where the arm sections of the coil electrodes generate magnetic fields having directions reverse to each other or in order to minimize the arm-section region where the intensity of the magnetic field is lowered, it is only necessary to make the positions of the fixed-side and movable-side arm sections coincide with each other so that the fixed-side and movable-side arm sections are superimposed on each other; however, in that case, because the fixed-side and movable-side protruding sections are separated from each other and hence the energization path for an electric current becomes long, there has been a problem that the resistance increases.

The objective of the present invention is to provide a vacuum valve that solves the foregoing problems, that is inexpensively formed and reduces the resistance without lowering the intensity of the axis-direction magnetic field, and that satisfies the cutoff performance and the energization performance concurrently.

Means for Solving the Problems

A vacuum valve according to the present invention includes a fixed-side electrode rod fixedly provided at one end of a cylindrical, bottomed vacuum container; a movable-side electrode rod movably provided at the other end of the vacuum container; ring-shaped fixed-side and movable-side coil electrodes that are provided on the respective ends, of the fixed-side and movable-side electrode rods, that face each other, and generate axis-direction magnetic fields in a direction along an axis line of the fixed-side and movable-side electrode rods; contacts that are provided on the respective sides, of the fixed-side and movable-side coil electrodes, that face each other; and supporting members that are provided on the respective rear sides of the contacts and reinforces axis-direction strength. The vacuum valve according to the present invention is characterized in that each of the fixed-side and movable-side coil electrodes has a ring section provided on a plane perpendicular to the axis line and concentrically with the axis line, a plurality of arm sections extended outward from the outer circumference of the ring section, circular-arc-shaped coil sections that are formed in such a way as to be bent in the circumferential direction from the respective front ends of the arm sections, slits that separate the coil sections, and protruding sections each provided at a position that is situated at the circumferential-direction front end of the coil section and at which at least part thereof and the extending direction of the arm section overlaps each other and each bonded to the contact, and is characterized in that when viewed in the axis direction of the fixed-side and movable-side electrode rods, the slit is obliquely formed in such a way as to advance from a position at which the arm section and the protruding section starts to overlap each other toward the middle of the arm section and then reach the outer circumference of the coil section.

Advantage of the Invention

The present invention makes it possible to eliminate the section, surrounded by the fixed-side and movable-side arm sections and the fixed-side and movable-side protruding sections, that generates a magnetic field in a direction reversed to the direction of the magnetic field generated by the coil section of the coil electrode, and to minimize the region of the arm section where the intensity of the magnetic field is lowered; therefore, a uniform and wide axis-direction magnetic field can be generated between the fixed-side contact and the movable-side contact. Accordingly, a vacuum valve that is superior in the cutoff performance can be provided.

BEST MODE FOR CARRYING OUT THE INVENTION

Hereinafter, Embodiments of a vacuum valve according to the present invention will be explained with reference to the drawings.

Embodiment 1

Figure 1:
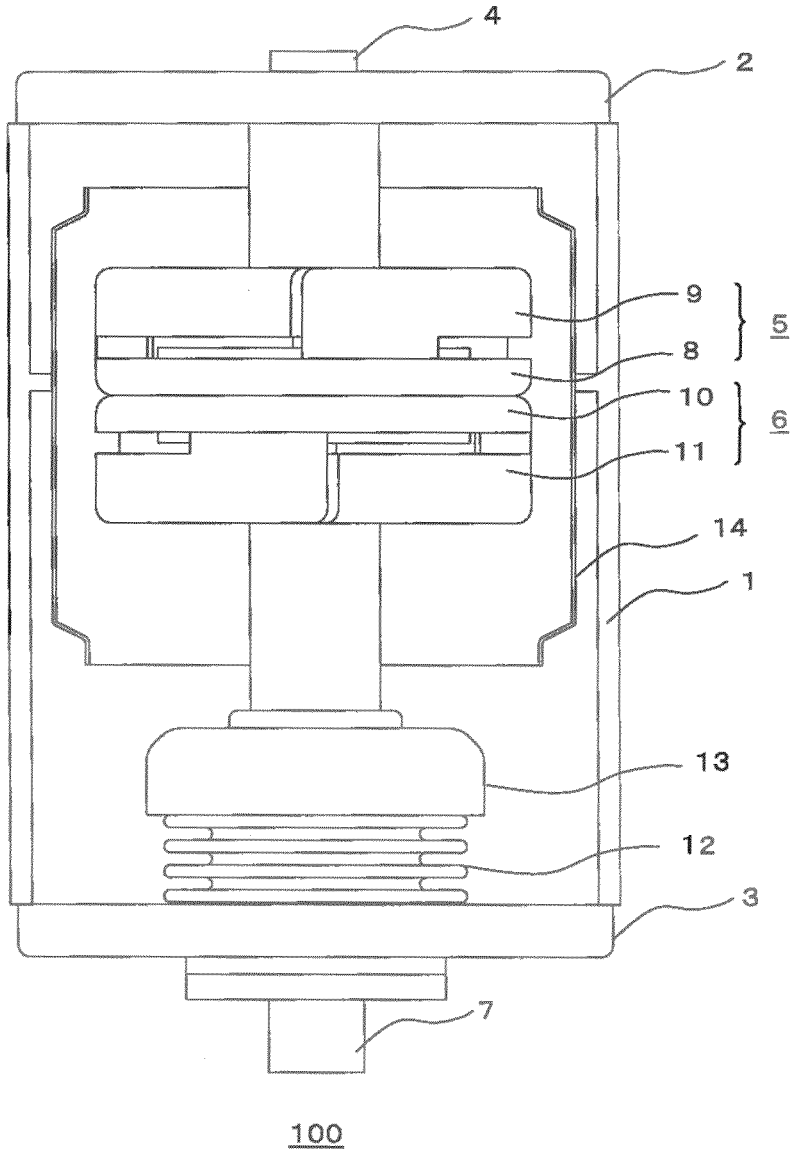
FIG. 1 is a configuration view illustrating a vacuum valve according to Embodiment 1 of the present invention.
Figure 2:
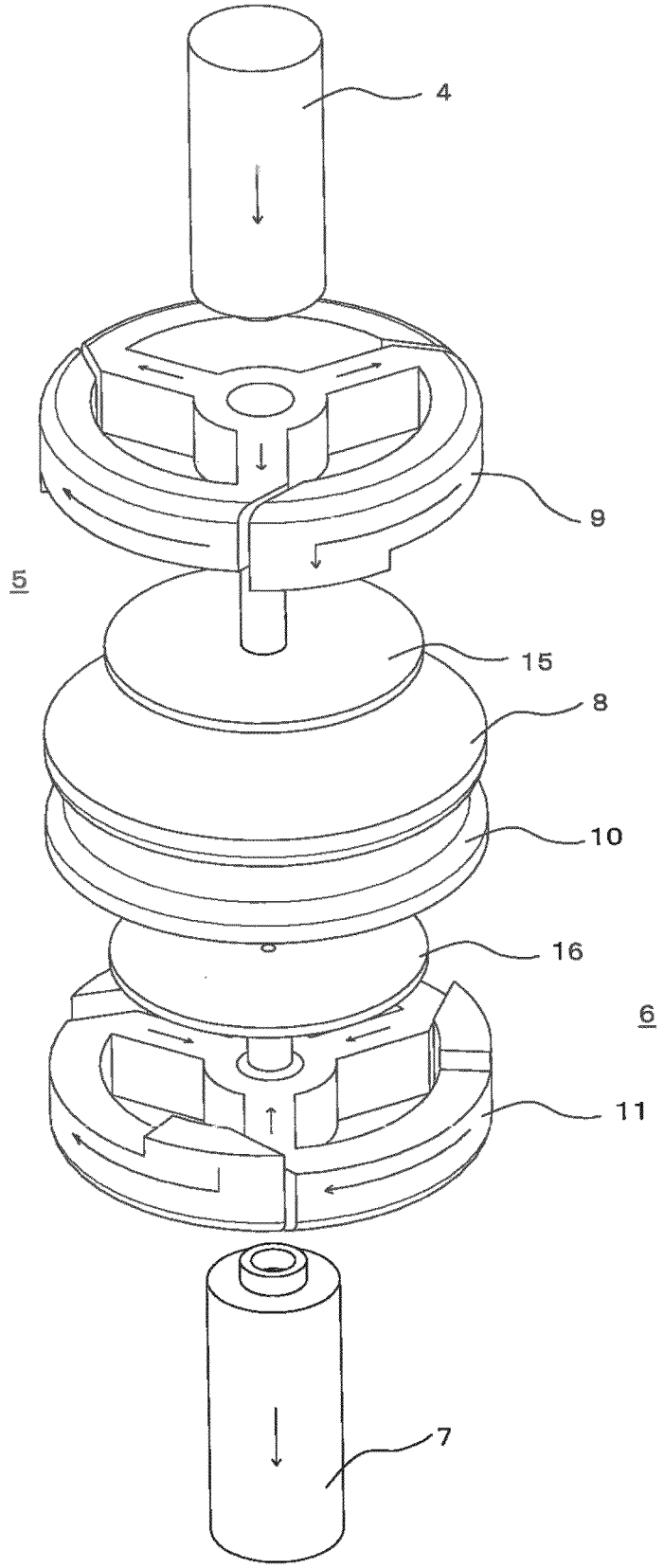
FIG. 2 is an exploded perspective view for explaining the configurations of coil electrodes of the vacuum valve according to Embodiment 1 of the present invention.
Figure 3A:
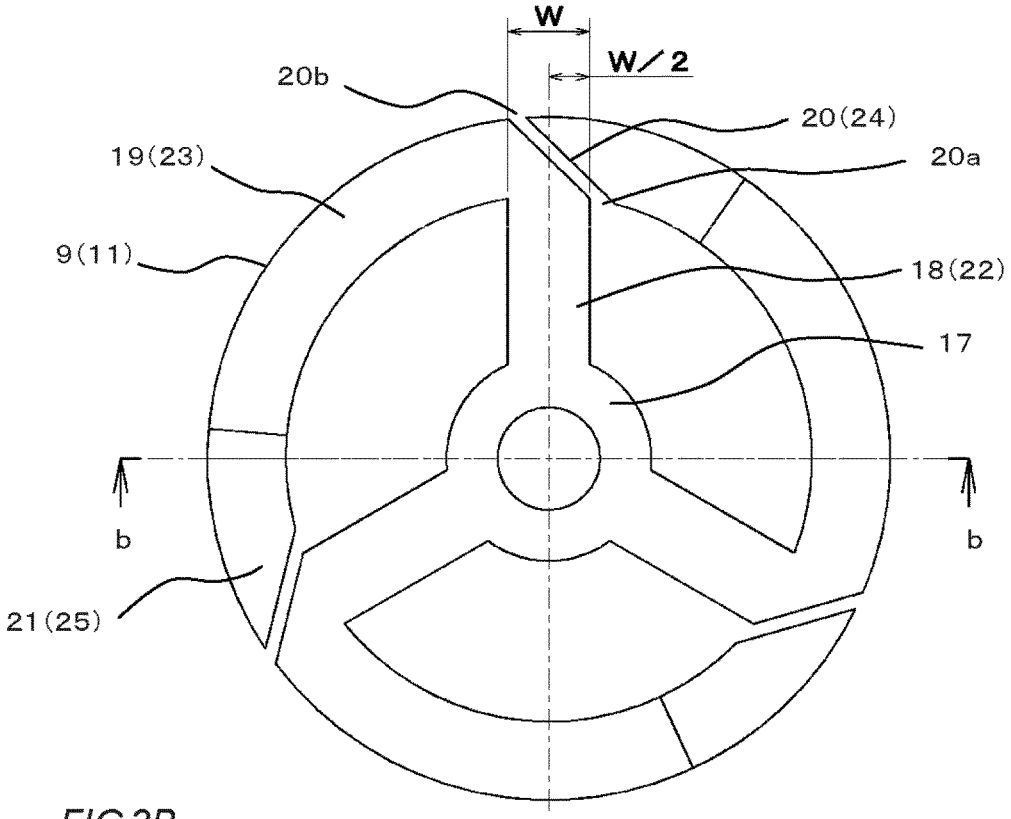
FIG. 3A is a plan view of a fixed-side coil electrode of the vacuum valve according to Embodiment 1 of the present invention.
Figure 3B:
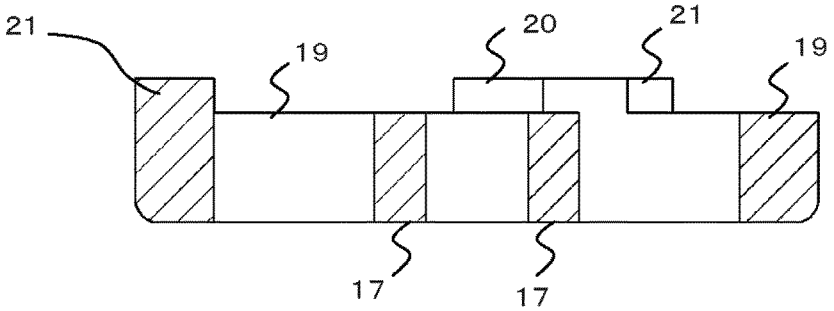
FIG. 3B is a cross-sectional elevation view taken along the b-b line in FIG. 3A.

FIG. 1 is a configuration view illustrating a vacuum valve according to Embodiment 1 of the present invention; FIG. 2 is an exploded perspective view for explaining the configurations of electrodes; FIG. 3A is a plan view of a fixed-side coil electrode and FIG. 3B is a cross-sectional elevation view taken along the b-b line if FIG. 3A. In each of the drawings, the same reference characters denote the same or similar sections.

In FIG. 1, a vacuum valve 100 is provided with an insulating cylinder 1 formed of alumina ceramics or the like. On one of end openings of the insulating cylinder 1, a fixed-side end plate 2 for covering the one of end openings is provided; on the other end opening of the insulating cylinder 1, a movable-side endplate 3 for covering the other end opening is provided. On the respective end faces of the insulating cylinder 1, the fixed-side and movable-side endplates 2 and 3 are mounted through brazing in a coaxial manner.

On the fixed-side end plate 2, there are provided a fixed-side electrode rod 4 brazed to the fixed-side end plate 2 and a fixed-side electrode 5 brazed to the fixed-side electrode rod 4. A movable-side electrode 6 is provided in such a way as to face the fixed-side electrode 5; a movable-side electrode rod 7 is brazed to the movable-side electrode 6. In addition, as described later, the fixed-side electrode 5 is configured with a fixed-side contact 8 and a fixed-side coil electrode 9; the movable-side electrode 6 is configured with a movable-side contact 10 and a movable-side coil electrode 11.

A bellows 12 produced, for example, with thin stainless steel in a bellows-like shape is provided between the movable-side end plate 3 and the movable-side electrode 6; the movable-side electrode rod 7 is movably provided in the bellows 12 in such a way that the bellows 12 maintains the vacuum airtightness; the bellows 12 makes it possible to connect or disconnect the fixed-side electrode 5 and the movable-side electrode 6 while maintaining the vacuum airtightness. A bellows cover 13 brazed to the movable-side electrode rod 7 is provided on the top end of the bellows 12. In order to suppress metal vapor, which is produced by an electric arc that is caused between the fixed-side electrode 5 and the movable-side electrode 6 at a time when an electric current is cut off, from adhering to the inner surface of the insulating cylinder 1, an arc shield 14 is provided in such a way as to enclose the fixed-side electrode 5 and the movable-side electrode 6.

The fixed-side electrode 5 and the movable-side electrode 6 have the respective electrode configurations that generate axis-direction magnetic fields in the direction along the axis line of the fixed-side and movable-side electrode rods 4 and 7. Thus, next, the detailed configurations of the fixed-side electrode 5 and the movable-side electrode 6 will be explained with reference to FIGS. 2, 3A and 3B.

Because basically, the fixed-side electrode 5 and the movable-side electrode 6 have the respective configurations similar to each other, the fixed-side electrode 5, as a representative, will be explained below. For the sake of reference, in the drawings, the reference characters of the movable-side electrode 6 corresponding to those of the fixed-side electrode 5 are indicated in parentheses. Accordingly, in the case of the movable-side electrode 6, it is only necessary to replace "fixed-side" in the following explanation by "movable-side" and to utilize the reference characters in the parentheses. The explanation will be made with reference to those reference characters, as may be necessary.

As illustrated in FIG. 2, the fixed-side electrode 5 is configured with the disk-shaped fixed-side contact 8, as the main electrode; the fixed-side coil electrode 9 that is provided, concentrically with the axis line of the fixed-side and movable-side electrode rods 4 and 7, on a plane perpendicular to the axis line, and on the rear side of the fixed-side contact 8 (on one side, of the fixed-side contact 8, that is opposite to the other side thereof at which the fixed-side and movable-side electrodes 5 and 6 face each other); and a fixed-side supporting member 15 that is formed of a high-resistance material such as stainless steel and supports the fixed-side contact 8 toward the fixed-side electrode rod 4. It is desirable that as the fixed-side contact 8, a material such as silver-based alloy or copper-based alloy is utilized; as the fixed-side coil electrode 9, a material such as copper or a copper-based material is utilized. As described above, a movable-side supporting member 16, the movable-side contact 10, and the movable-side coil electrode 11 are configured in a manner the same as that in which the fixed-side counterparts are configured. In the following explanation for the respective configurations, the respective sides, of the fixed-side and movable-side electrodes 5 and 6, that face each other are referred to as "front sides"; the respective opposite sides, of the fixed-side and movable-side electrodes 5 and 6, that are facing the fixed-side and movable-side electrode rods 4 and 7 are referred to as "rear sides".

FIGS. 3A and 3B are a view illustrating the fixed-side coil electrode 9; FIG. 3A is a plan view; FIG. 3B is a cross-sectional elevation view taken along the b-b line in FIG. 3A. As illustrated in FIGS. 3A and 3B, the fixed-side coil electrode 9 has a fixed-side ring section 17 that is situated at the center portion thereof; a plurality (three pieces, in FIG. 3A) of fixed-side arm sections 18 that extend from the outer circumference in such a way as to be approximately evenly spaced from one another; circular-arc-shaped fixed-side coil sections 19 that are formed in such a way as to be bent in the circumferential direction from the respective front ends of the fixed-side arm sections 18; fixed-side coil slits 20 that separate the fixed-side coil sections 19; and fixed-side coil protruding sections 21 that are provided at the respective front ends (terminal ends) of the fixed-side coil sections 19 and are bonded to the fixed-side contact 8.

The fixed-side coil section 19 is provided at a position that is on an outer concentric circle of the fixed-side ring section 17 and is obtained by evenly dividing the circumference of the outer concentric circle; the fixed-side coil section 19 functions as a magnetic-field generation coil. The fixed-side coil protruding section 21 is formed by making part of the front end, of the fixed-side coil section 19, that faces the rear side of the fixed-side contact 8 protrude by a predetermined length in the axis direction; the fixed-side coil protruding section 21 is a section to be brazed to the rear side of the fixed-side contact 8.

The fixed-side coil slit 20 that separate the fixed-side coil sections 19 is formed in such a way that the position of a coil-inner-diameter slit end 20*a* is on the cross point of the fixed-side arm section 18 and an inner-diameter protruding end of the fixed-side coil section 19 and in such a way that letting W denote the width of the fixed-side arm section 18, the position of a coil-outer-diameter slit end 20*b* is in a range from W/2 to W. FIGS. 3A and 3B illustrates an example of the position of the coil-outer-diameter slit end 20*b* at a time when the width of the fixed-side arm section 18 is W.

Figure 4:
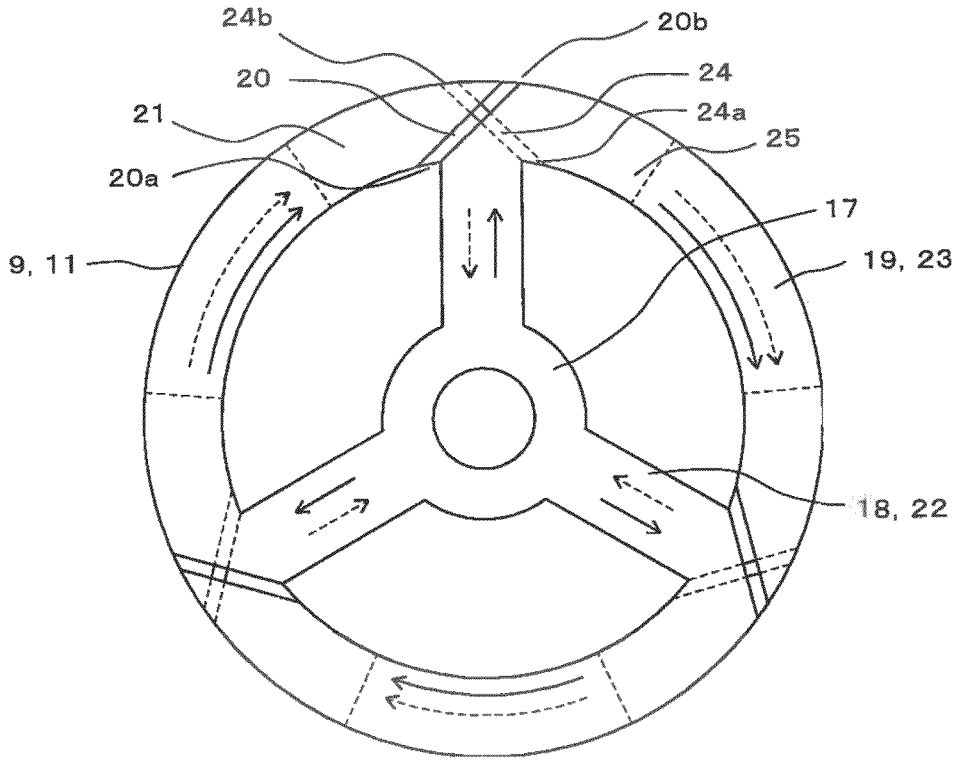
FIG. 4 is an explanatory view illustrating the state where the fixed-side coil electrode and a movable-side coil electrode of the vacuum valve according to Embodiment 1 of the present invention are superimposed on each other.
Figure 5:
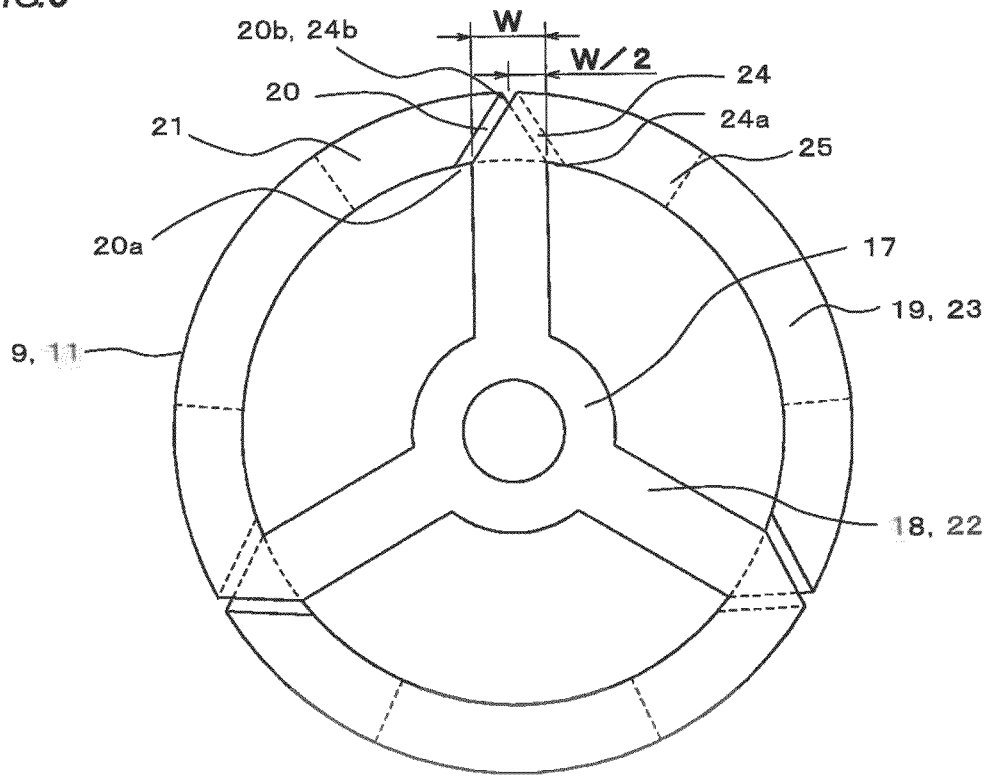
FIG. 5 is an explanatory view illustrating the state where a fixed-side coil electrode and a movable-side coil electrode of a vacuum valve according to Embodiment 2 of the present invention are superimposed on each other.
Figure 6:
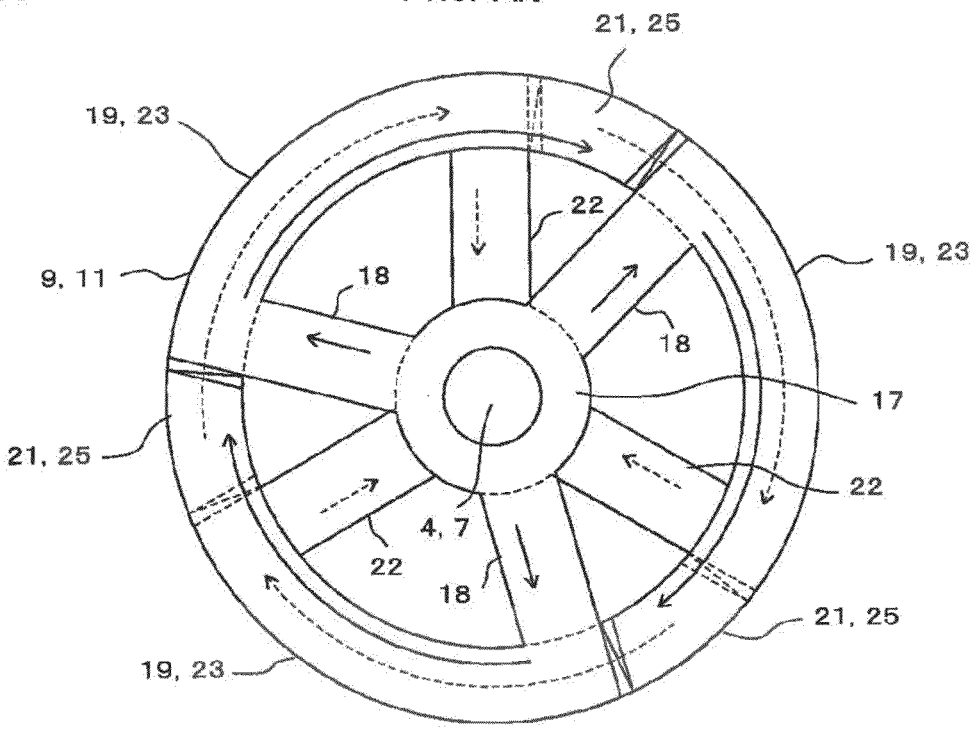
FIG.6 Prior Art
FIG. 6 is an explanatory view illustrating the state where a fixed-side coil electrode and a movable-side coil electrode of a conventional vacuum valve are superimposed on each other.
Figure 7:
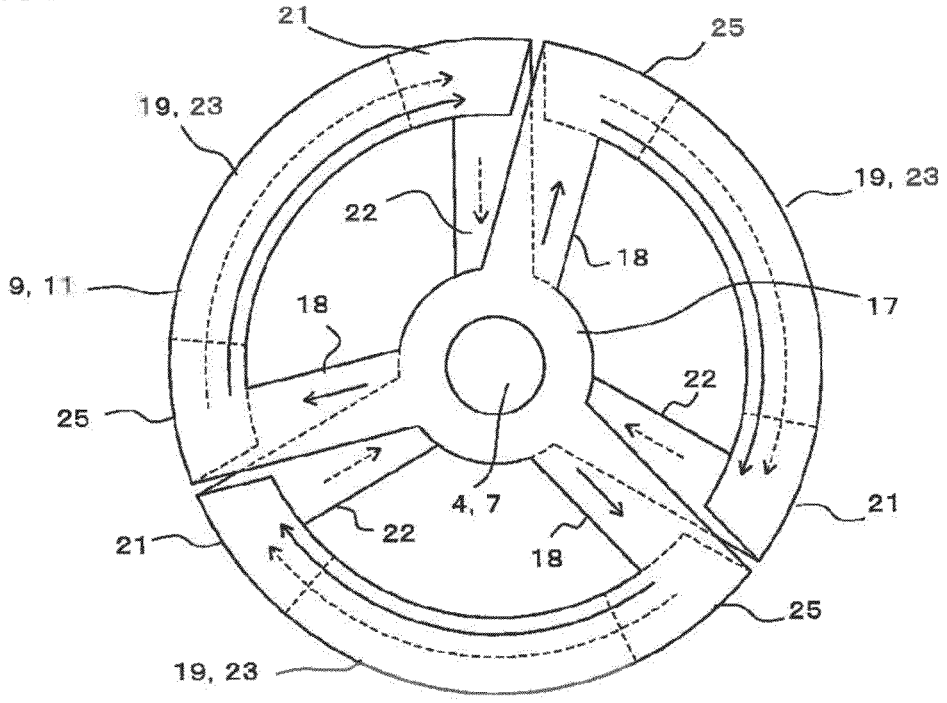
FIG.7 Prior Art
FIG. 7 is an explanatory view illustrating another state where the fixed-side coil electrode and the movable-side coil electrode of the conventional vacuum valve are superimposed on each other.

FIG. 5 is an explanatory view illustrating the state in which the fixed-side coil electrode 9 and the movable-side coil electrode 11, configured in such a way as described above, are superimposed on each other so that the positional relationship between the fixed-side coil electrode 9 and the movable-side coil electrode 11 that are integrated in the vacuum valve 100 can be understood. As illustrated in FIG. 4, when the positions of the fixed-side arm section 18 and the movable-side arm section 22 are made to coincide with each other so that they are superimposed on each other, not only there is eliminated the region where a magnetic field is generated in a direction reversed to the direction of the magnetic field generated by the fixed-side coil section 19 and the movable-side coil section 23, but also there can be minimized the regions of the fixed-side arm section 18 and the movable-side arm section 22, in which the intensity of the magnetic field is lowered. As a result, the magnetic field generated between the fixed-side electrode 5 and the movable-side electrode 6 can be made uniform and the area thereof can be enlarged. Because the fixed-side and movable-side coil slits 20 and 24 are obliquely formed, the fixed-side coil protruding section 21 and the movable-side coil protruding section 25 can be configured in such a way as to be not separated from each other; therefore, the resistance is suppressed from increasing.

As described above, according to Embodiment 1, the foregoing effect realizes the small-sized, high-cutoff-performance, and a low-resistance vacuum valve 100.

Embodiment 2

Next, a vacuum valve according to Embodiment 2 of the present invention will be explained. FIG. 5 is an explanatory view illustrating another state where a fixed-side coil electrode and a movable-side coil electrode of a vacuum valve according to Embodiment 2 are superimposed on each other. The vacuum valve is configured in a manner the same as or equivalent to that in which the vacuum valve according to Embodiment 1 is configured. In FIG. 5, the elements the same as or equivalent to those in FIG. 4 are designated by the same reference characters.

The fixed-side coil section 19 of the fixed-side coil electrode 9 is provided at a position that is on an outer concentric circle of the fixed-side ring section 17 and is obtained by evenly dividing the circumference of the outer concentric circle; the fixed-side coil section 19 functions as a magnetic-field generation coil. The fixed-side coil protruding section 21 is formed by making part of the front end, of the fixed-side coil section 19, that faces the rear side of the fixed-side contact 8 protrude by a predetermined length in the axis direction; the fixed-side coil protruding section 21 is brazed to the rear side of the fixed-side contact 8. The fixed-side coil slit 20 that separate the fixed-side coil sections 19 is formed in such a way that the position of the coil-inner-diameter slit end 20*a* is on the cross point of the fixed-side arm section 18 and an inner-diameter protruding end of the fixed-side coil section 19 and in such a way that letting W denote the width of the fixed-side arm section 18, the position of the coil-outer-diameter slit end 20*b* is at a position of W/2.

When as illustrated in FIG. 5, the position of the coil-outer-diameter slit end 20*b* of the fixed-side coil slit 20 is set to the position of W/2 so that the position of the coil-outer-diameter end 20*b* of the fixed-side coil slit 20 and the position of the coil-outer-diameter end 24*b* of the movable-side coil slit 24 coincide with each other, the fixed-side arm section 18 and the movable-side arm section 22 is automatically superimposed on each other. In the foregoing configuration according to Embodiment 1, in order to make the respective positions of the fixed-side arm section and the movable-side arm section of the coils provided on the respective rear sides of the contacts coincide with each other when the vacuum valve is assembled, it is required to perform positioning with a marking-off line or the like that functions as a mark with which the positions of the arm sections are recognized when the coils are viewed from the outside. However, such a configuration according to Embodiment 2 facilitates the positioning and assembly work; thus, there can be realized a low-resistance and inexpensive vacuum valve in which the magnetic field generated between the fixed-side electrode and the movable-side electrode is uniform and the area thereof is wide.

Heretofore, the respective vacuum valves according to Embodiments 1 and 2 of the present invention have been explained; however, in the scope of the present invention, the embodiments thereof can freely be combined with one another and can appropriately be modified or omitted.

The invention claimed is:

1. A vacuum valve comprising:

a fixed-side electrode rod fixedly provided at one end of a cylindrical, bottomed vacuum container;

a movable-side electrode rod movably provided at the other end of the vacuum container;

ring-shaped fixed-side and movable-side coil electrodes that are provided on the respective ends, of the fixed-side and movable-side electrode rods, that face each other, and generate axis-direction magnetic fields in a direction along an axis line of the fixed-side and movable-side electrode rods;

contacts that are provided on the respective sides, of the fixed-side and movable-side coil electrodes, that face each other; and supporting members that are provided on the respective rear sides of the contacts and reinforces axis-direction strength, wherein each of the fixed-side and movable-side coil electrodes has a ring section provided on a plane perpendicular to the axis line and concentrically with the axis line, a plurality of arm sections extended outward from the outer circumference of the ring section, circular-arc-shaped coil sections that are formed in such a way as to be bent in the circumferential direction from the respective front ends of the arm sections, slits that separate the coil sections, and protruding sections each provided at a position that is situated at the circumferential-direction front end of the coil section and at which at least part thereof and the extending direction of the arm section overlaps each other and each bonded to the contact; and wherein when viewed in the axis direction of the fixed-side and movable-side electrode rods, the slit is obliquely formed in such a way as to advance from a position at which the arm section and the protruding section starts to overlap each other toward the middle of the arm section and then reach the outer circumference of the coil section.

2. The vacuum valve according to claim 1, wherein the fixed-side coil electrode and the movable-side coil electrode are arranged in such a way that the respective arm sections are superimposed on each other.

3. The vacuum valve according to claim 1, wherein letting W denote the width of the arm section, the slit is obliquely formed from the cross point of the arm section and the protruding section to a position, on the outer diameter of the coil section, that is within a range from W/2 to W with respect to said cross point.

4. The vacuum valve according to claim 1, wherein letting W denote the width of the arm section, the slit is obliquely formed from the cross point of the arm section and the protruding section to a position, on the outer diameter of the coil section, that is W/2 from said cross point; and wherein the fixed-side coil electrode and the movable-side coil electrode are arranged in such a way that the respective slits coincide with each other.

* * * * *